US005299738A

United States Patent [19]

Genter et al.

[11] Patent Number: 5,299,738

[45] Date of Patent: Apr. 5, 1994

[54] HIGH PRESSURE FUEL INJECTOR WITH CUSHIONED PLUNGER STOP

[75] Inventors: David P. Genter; Lester L. Peters, both of Columbus, Ind.

[73] Assignee: Cummins Engine Company, Inc., Columbus, Ind.

[21] Appl. No.: 945,390

[22] Filed: Sep. 16, 1992

[51] Int. Cl.[5] ..... F02M 61/20

[52] U.S. Cl. ..... 239/91; 239/95; 123/467

[58] Field of Search ..... 239/88-96, 239/124, 125, 132.5, 533.2-533.12, 584; 123/467, 516

[56] References Cited

U.S. PATENT DOCUMENTS

| | | | |
|---|---|---|---|
| 3,831,846 | 8/1974 | Perr et al. | 239/89 |
| 4,149,506 | 4/1979 | Muntean et al. | 239/88 |
| 4,471,909 | 9/1984 | Perr | 239/89 |
| 4,721,247 | 1/1988 | Perr | 239/91 |
| 4,986,472 | 1/1991 | Warlick et al. | 239/88 |
| 5,040,727 | 8/1991 | Muntean et al. | 239/91 |
| 5,076,240 | 12/1991 | Perr | 239/88 |

*Primary Examiner*—Karen B. Merritt

*Attorney, Agent, or Firm*—Sixbey, Friedman, Leedom & Ferguson

[57] ABSTRACT

An improved high pressure fuel injector for internal combustion engines of the type having a plunger assembly, with a plurality of plungers, that is mounted within a central bore within the body of the fuel injector for reciprocal movement, the plunger assembly having an upper plunger and a lower plunger mounted for reciprocal motion within the central bore and a variable volume injection chamber in said lower end of the central bore between the injection orifice and a bottom end of the lower plunger. In accordance with a preferred embodiment, the problem of large quantities of air being drawn into the injector from the combustion chamber during the retraction stroke injection stroke is avoided by limiting the return stroke of the lower plunger to a distance that is significantly less than that of the stroke of the upper plunger of the plunger assembly. Furthermore, a cushioned stopping of the return movement of the lower plunger is obtained and the injector is also able to allow different maximum injectable charge capabilities to be produced from the same basic set of components without requiring more than the return spring assembly and injector nozzle to be changed.

21 Claims, 4 Drawing Sheets

HIGH PRESSURE FUEL INJECTOR WITH CUSHIONED PLUNGER STOP

BACKGROUND OF THE INVENTION

1. Field of the Invention

The present invention is related to the field of high pressure fuel injectors for internal combustion engines of the type having a plunger assembly, with a plurality of plungers, that is mounted within a central bore within the body of the fuel injector for reciprocal movement. More specifically, the invention relates to such a fuel injector where the plunger assembly has an upper plunger and a lower plunger mounted for reciprocal motion within the central bore and a variable volume injection chamber in said lower end of the central bore between the injection orifice and a bottom end of the lower plunger.

2. Description of Related Art

A fuel injector of the initially mentioned type is known, for example, from U.S. Pat. Nos. 4,721,247 and 4,986,472 (which are owned by the assignee of this application). While an improvement over then existing fuel injections systems, such fuel injectors have a return spring which serves to draw the lower injection plunger upwardly into engagement with an intermediate plunger to force these plungers and an upper plunger together after completion of an injection cycle until metering and timing has commenced for the next cycle, and thereby, establishing a preload force which must be overcome to meter timing fluid into the timing chamber (between the upper and intermediate plungers) to vary the advancement of injection timing. Thus, even though, at times, there is relative movement between the plungers of the plunger assembly, during retraction of the plunger assembly, the lower plunger executes the same retraction stroke as the upper plunger. As a result, a considerable quantity of air is drawn from the combustion chamber of the engine, through the open nozzle, into the fuel metering, variable volume injection chamber during the retraction stroke of the plunger assembly. This fuel-laden air, when compressed during the next injection stroke, can detonate and lead to premature detonation of the fuel which has been metered into the injection chamber, as well. In fact, during development of this invention an attempt was made to use a rigid stop; however, this stop showed extreme wear and cracking after a few hours of operation since the plunger was hitting the stop at near the maximum plunger retraction velocity.

Of course, the use of abutments to limit the stroke of a reciprocable member is commonly known in a wide variety of fields too numerous to mention. However, in the context of a plunger assembly of a high pressure fuel injector, repeated high speed metal-to-metal contact between a plunger and an injector body component, in which the momentum of the plunger must be absorbed by the injector body component, is undesirable from a number of standpoints including wear, noise, etc.

SUMMARY OF THE INVENTION

In view of the foregoing, it is an object of the present invention to provide an improved high pressure fuel injector for internal combustion engines in which the problem of large quantities of air being drawn into the injector from the combustion chamber during the retraction stroke and that, then, is compressed to the point of detonation during the injection stroke, can be avoided.

A second object of the present invention is to provide an improved high pressure fuel injector for internal combustion engines which can achieve the preceding object by providing for the return stroke of the lower plunger to be limited to significantly less than that of the stroke of the upper plunger of the plunger assembly.

Yet another object of the present invention is to provide a high pressure fuel injector for internal combustion engines that uses an improved lower plunger and return spring arrangement which affords a cushioned stopping of return movement of the lower plunger.

Still further, it is an object of the present invention to achieve the preceding objects in a way that allows the fuel injectors having different maximum injectable charge capabilities to be produced from the same basic set of components without requiring more than the return spring assembly and injector cup to be changed.

In accordance with preferred embodiments of the present invention, these objects are obtained by an improved high pressure fuel injector for internal combustion engines of the type having a plunger assembly, with a plurality of plungers, that is mounted within a central bore within the body of the fuel injector for reciprocal movement, the plunger assembly having an upper plunger and a lower plunger mounted for reciprocal motion within the central bore and a variable volume injection chamber in the lower end of the central bore between the injection orifice and a bottom end of the lower plunger. In accordance with preferred embodiments, the problem of large quantities of air being drawn into the injector from the combustion chamber during the retraction stroke injection stroke is avoided by limiting the return stroke of the lower plunger to a distance that is significantly less than that of the stroke of the upper plunger of the plunger assembly by a cushioned stopping of the return movement of the lower plunger that is obtained by spring stop that may, optionally, be hydraulically damped. The injector is also able to allow different maximum injectable charge capabilities to be produced from the same basic set of components selecting between spring keepers of differing thicknesses and/or selecting between injector cups having differently sized injection chambers.

These and other objects, features and advantages of the present invention will become more apparent from the following detailed description of the preferred embodiments of the invention when viewed in conjunction with the accompanying drawings.

DETAILED DESCRIPTION OF THE PREFERRED EMBODIMENTS

Figure 1:
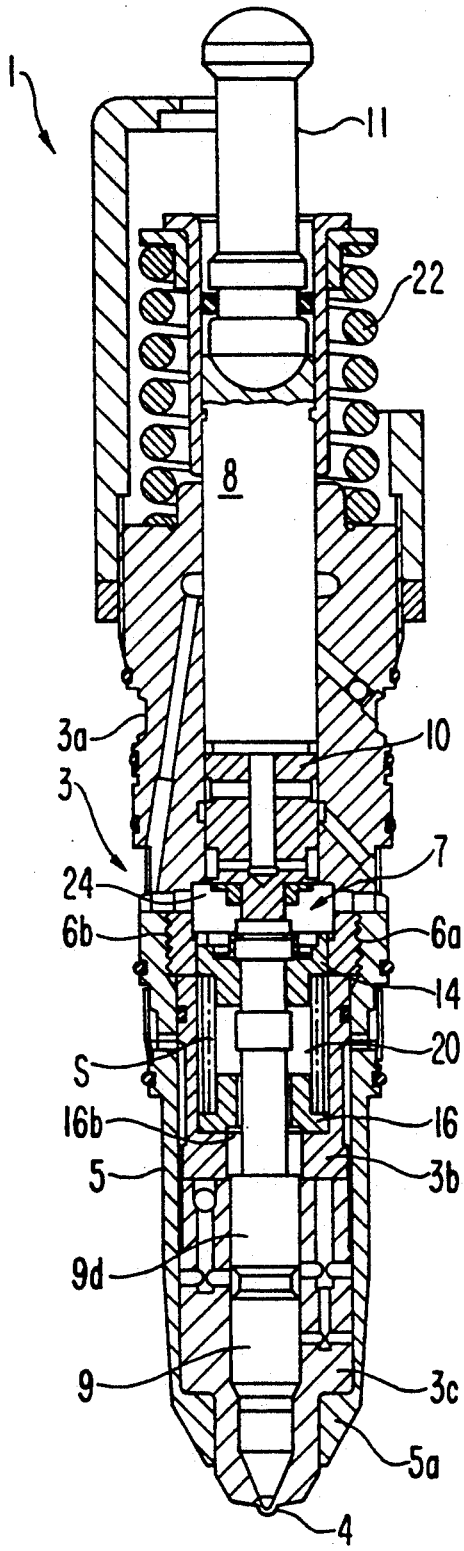
FIG. 1 is a partial cross-sectional view of an open nozzle fuel injector with a plunger assembly having a cushioned lower plunger stop in accordance with the present invention, shown during a hold-down phase at the end of its injection stroke.

FIG. 1 illustrates an open nozzle unit fuel injector in accordance with the present invention, which is designated generally by reference numeral 1. The fuel injector 1 is intended to be received within a recess in the head of an internal combustion engine (not shown) in a conventional manner. The injector 1 is formed of an injector body 3, that has an upper injector barrel part 3*a* (the section of which is shown on the left having been taken along a plane at a right angle to the section shown at the right in FIGS. 1-3), a lower injector barrel part 3*b*, an injector cup 3*c* having an injection nozzle having spray orifices for spraying fuel into the combustion chamber (not shown) of an internal combustion engine, and a retainer 5 having a shoulder 5*a* for capturing the injector cup 3*c*. The retainer 5 receives the injector cup 3*c*, supported on shoulder 5*a* with spray nozzle 4 projecting from the bottom end thereof. The lower barrel part 3*b* is received in the retainer 5 supported on the injector cup 3*c*. Furthermore, retainer 5 secures the injector cup 3*c* and lower barrel part 3*b* together in end-to-end fashion with the upper barrel part 3*a*. For this purpose, the top end of the retainer 5 has internal threads 6*a* by which it is connected to external threads 6*b* on the bottom end of upper injector barrel part 3*a*, as shown. A central bore extends through the parts 3*a*-3*c* of the injector body 3 of the fuel injector 1, and a reciprocating plunger assembly 7 is disposed in this central bore.

The plunger assembly 7 includes three plungers. An upper plunger 8, an injection plunger 9 and a timing plunger 10 disposed therebetween. The fuel injector 1 is part of a fuel injection system having a plurality of such injectors, each of which is driven by a rotating camshaft (not shown) via a conventional drive train assembly which includes a link 11 that causes the plunger assembly 7 to reciprocate in synchronism therewith. The injection system also includes a fuel pump which supplies all of the fuel injectors by a common rail system (not shown) which requires three common fluid rails within the cylinder head, one for supplying fuel into the injection chamber, one for draining away fuel that is not injected and the third which supplies timing fluid (which may also be fuel) to vary the timing of the injection event by varying the quantity of timing fluid supplied to a variable volume timing chamber defined between the bottom of the upper plunger 8 and the top of the timing plunger 10. These aspects are not novel to the present invention and are described in greater detail in the above-noted U.S. Pat. No. 4,721,247. The '027 patent also describes the need to drain timing fluid, at the end of each injection cycle to assure a sharp cut off of the injection event and whenever the injection pressure exceeds a preset value during the injection stroke to preclude excessive wear and stress in the injector's drive train.

Figure 2:
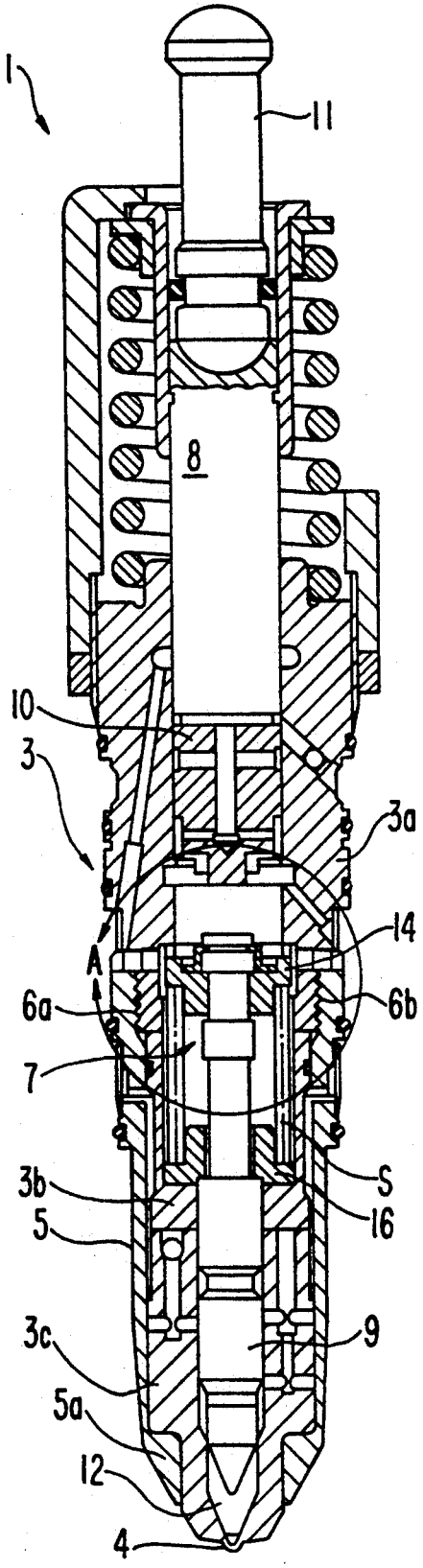
FIG. 2 is a view corresponding to that of FIG. 1 but with the plunger assembly shown in a fully retracted position.

The difference in structure and operation of the injector of the present invention lies in the manner and means by which the return stroke of the plunger assembly 7, from the FIG. 1 position to the FIG. 2 position, is achieved. In particular, with reference to FIG. 1, at the end of the injection stroke of plunger assembly 7, after a hold down phase, all of the fuel metered into the injection chamber 12 (FIG. 2) has been delivered into the combustion chamber of the engine cylinder. In this position, the lower plunger is held seated in the bottom end of the injection cup 3, against the force of a now-compressed return spring S, by the end-to-end contact between the plungers 8-10 which have been fully driven into the injector body by the action of the link 11 and the drive train associated therewith. The return spring S is captured between an upper spring keeper 14 and a lower spring keeper 16, both of which are of a stepped washer-like construction.

Figure 2A:
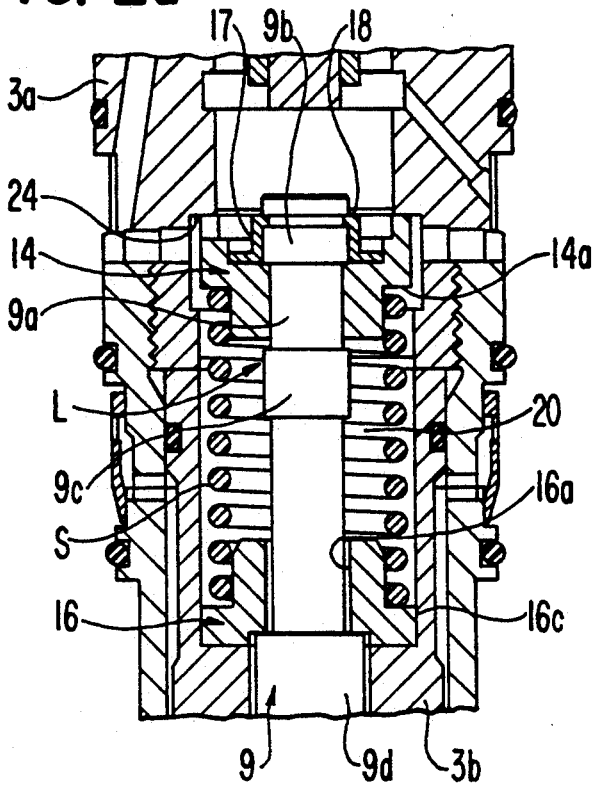
FIG. 2*a* is an enlarged view of a central portion of FIG. 2.
Figure 4:
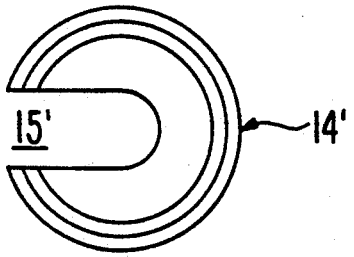
FIG. 4 is a top view of the upper spring keeper shown in FIG. 3.

The upper spring keeper 14 may be annular and sized to fit axially over the land 9*b* but not the land 9*c* (lands 9*b*, 9*c*, and 9*d* would be of successively greater diameters), or horseshoe-shaped (as shown for spring keeper 14' in FIG. 4) and slid radially onto a reduced diameter portion 9*a* of lower plunger 9 that is located between the pair of lands 9*b*, 9*c*, and retained in place by a retainer ring 17 and spring clip 18, as shown most clearly in FIG. 2*a*. Upper spring keeper 14 also has a flange 14*a* against which the upper end of the spring S abuts. This flange 14*a* has a notch 15 which provides a path for draining timing fluid and fuel (which is either released by the timing plunger or leaks upwardly through the clearance between the lower plunger 9 and the lower injector barrel part 3*b*) to the engine drain flowpath. However, in the case of a horseshoe-shaped upper spring keeper this function can be served by the gap (15') between the legs of the horseshoe shape.

The lower spring keeper 16 has a through-hole 16*a* that is large enough to pass over the lands 9*b* and 9*c* and has a counterbore 16*b* (FIG. 1) at its lower end within which a larger intermediate land 9*d* is able to be received, as shown in FIGS. 2 and 2*a*. The lower spring keeper 16 also has an annular flange 16*c* that abuts on the bottom of a spring recess 20 formed in lower barrel part 3*b* of the injector body 3 and carries the bottom end of spring S.

In the FIG. 1 position, the plunger assembly is in its innermost or lowermost position in which the spring S is compressed by the force applied to lower plunger 9 by link 11 via upper plunger 8, timing plunger 7. At this point in the injection cycle, injection of fuel into the engine has been completed and any remaining timing fluid drained from between the upper plunger 8 and the timing plunger 10, in a manner that forms no part of this invention. As link 11 is now lifted, a return spring 22 raises the upper plunger 8 and the timing plunger 10 is drawn upwardly with it (or a timing plunger return spring can be provided between the upper spring keeper 14 and the bottom of timing plunger 10).

With the removal of force from the lower plunger, spring S, acting through upper keeper 14, raises the lower plunger 9. If the lower plunger 9 were permitted to follow the full upward movement of plungers 8 and 10, a negative pressure effect would be produced and a large amount of air would be drawn into the increasing volume of variable volume injection chamber 12, with the adverse effect noted in the background portion of this application. Thus, a stop surface 24 is provided (which, in the illustrated embodiment, is provided on an inner wall of upper barrel 3*a*) that limits upward movement of the upper spring keeper 14 that can be produced by the spring S. Once upper keeper 14 engages stop surface 24, the considerable momentum of the lower plunger 9 causes it to continue freely upward through spring keepers 14, 16 until land 9*d* engages in counterbore 16*b*. At this point, the momentum of lower plunger 9 is transferred to spring S via lower keeper 16. On the other hand, the degree to which spring S is allowed to compress and permit further upward movement of lower plunger 16 is limited by the amount of lash or vertical play L provided between upper keeper 14 and the lands 9*b* and 9*c* of plunger 9. After the land 9*c* engages the upper spring keeper 14, the spring S relaxes and the lower plunger 9 is held in the FIG. 2, 2*a* position by the opposing forces exerted by the upper and lower spring keepers 14, 16 under the preload of spring S.

In this way, a cushioned stopping of the lower plunger 9 is produced which reduces wear and noise relative to that which would be the case if a rigid connection existed between the upper spring keeper 14 and the lower plunger 9 (in which case the upper spring keeper would have to absorb all of the momentum of this rigid metal component). At the same time, the stroke of lower plunger 9 can be limited to an amount which is just sufficient to produce an injection chamber 12 that has a maximum volume which essentially equals that of the maximum dosage of fuel that it will be necessary for the injector to inject. In this way, detonation of the fuel within the injector can be avoided. That is, if the lower plunger 9 followed the full, for example, one inch stroke of the upper plunger 8, a considerable vacuum would be created under it and plunger 9 would draw in a lot of air from the combustion chamber of the engine. This air would be greatly compressed during the downstroke and could lead to detonation of the fuel within the injection chamber, especially since this air would, itself, become fuel laden. In contrast, by limiting the upward movement of the lower plunger 9 to, for example, half that of the upper plunger 8 (e.g., one-half inch vs. one inch), both the amount of air and the degree to which it is compressed and heated can be reduced to an extent that fuel detonation can be avoided.

With the injector 1 returned back into the raised position shown in FIG. 2, the next injection cycle commences with an injection timing mode in which timing fluid is supplied via a timing fluid supply passage to the reduced diameter lower end of upper plunger 8, and in a conventional manner, the supplied timing fluid displaces the timing plunger 10, filling a variable volume timing chamber between the upper and timing plungers 8, 10 with an amount of timing fluid designed to appropriately adjust the timing at which injection of fuel from nozzle 4 commences. Because spring S is unable to apply a load to the timing plunger 10, via injection and metering plunger 9, due to the travel of plunger 9 having been stopped, additional advantages beyond that noted above are obtained. That is, due to unloading of the timing plunger 10, the timing fluid metering pressure can be reduced during low speed operation and the spring force tolerance effect on injection timing accuracy is eliminated.

At the same time as timing fluid is being metered into the injector 1, the appropriate quantity of fuel to be injected is metered into injection chamber 12. After the appropriate quantities of timing fluid and fuel have been metered into the injector 1, the injection stroke is commenced with the upper plunger 8 and timing plunger 10 moving downwardly in unison due to the hydraulic link formed between them by the timing fluid in the timing chamber. Once the lower end of the timing plunger 10 engages the lower plunger 9, the lower plunger 9 commences its movement toward the FIG. 1 position and fuel is injected from chamber 12 into the combustion chamber of the engine. As can be appreciated, this portion of the injection cycle can proceed in the usual manner unaffected by the cushioned stop, spring arrangement.

As those skilled in the art are aware, the maximum quantity of fuel that must be able to be delivered by a fuel injector will vary between engines of differing designs and engine uses. Furthermore, in many respects, it would be as undesirable to use an injector of the present invention which is designed for a significantly larger maximum dosage requirement than will be needed in a particular engine application as it would be to use one which is designed for the intended maximum dosage requirements but is of a construction where the lower plunger executes the full stroke of the upper plunger. Thus, it would be advantageous if it were not necessary to have a number of different size injectors to meet all of the various engine needs, and instead, to be able to adapt a single fuel injector to various requirements through only minor modifications. This has been achieved in accordance with another feature of the present invention.

In particular, if it is assumed, by way of example, that the injector of FIGS. 1 and 2 has an upper plunger 8 which executes a stroke of 6.8 mm and is able to inject a maximum fuel dosage of 260 $mm^3$/stroke then it should be sufficient to accommodate a stroke of up to about 7.8 mm and a maximum fuel dosage of 328 $mm^3$/stroke merely through exchanging the injector cup 3*c* with one which will provide a larger (longer) injection chamber 12. On the other hand, should the stroke have to be increased by an even greater amount (e.g., to 9.8 mm with a commensurate increase in maximum fuel dosage), in addition to utilizing a different injector cup, it will be necessary to increase the distance achievable between the uppermost lower plunger position of FIG. 2 and its lowermost position of FIG. 1, this distance being a factor of the compressed height of spring S, the distance between the facing flanges 14*a*, 16*c* in the fully retracted position of FIG. 2, and the distance between the top of land 9*c* and the bottom of counterbore 16*b* in the fully inserted position of FIG. 1.

With the preceding in mind, and with reference to FIG. 3, it will now be explained how an increase in lower plunger stroke length can be simply and easily achieved, in accordance with the invention, by merely replacing the upper and lower spring keepers 14, 16 of FIGS. 1, 2 and 2*a* with the modified spring keepers 14',16' of FIG. 3. Since the other components of FIG. 3 correspond to those of FIG. 2*a*, the same reference numerals have been used for these parts in FIG. 3, and their nature and function are as already described above.

Figure 3:
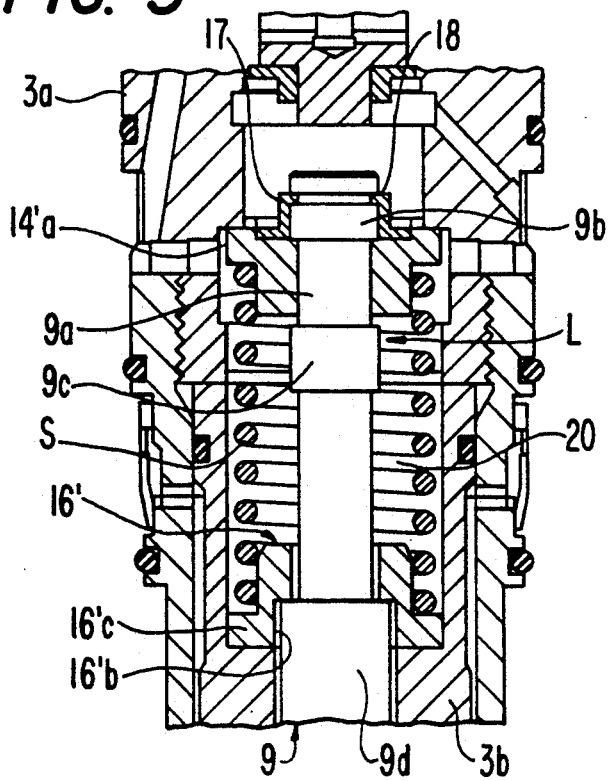
FIG. 3 is a view corresponding to that of FIG. 2*a* but with a modified spring keeper arrangement.

The differences between spring keepers 14, 16 and spring keepers 14', 16' are most easily seen from a comparison of FIGS. 2*a* and 3. From such a comparison, it can be seen that upper spring keeper 14' has a flange 14'*a* of a height/thickness which is substantially less than that of flange 14*a*, thereby allowing the top of spring S to expand further into the upper barrel part 3*a*. Also apparent is the fact that the counterbore 16'*b* is significantly deeper than counterbore 16, thereby causing the land 9*d* of the plunger 9 to move further upward before it engages the lower keeper 16' and is brought to a cushioned stop by the spring S; however, the amount of lash or play L remains the same. Thus, the maximum stroke of the lower plunger 9 can be increased by an amount that is equal to the sum of the decrease in the thickness of flange 14'a relative to flange 14a and the increase in depth of counterbore 16'c in comparison to counterbore 16c.

With regard to spring S, the same spring will usually be able to act on plunger 9 even though a stroke length adjustment is made, as mentioned above, solely through use of a different injector cup 3c. On the other hand, due to the increased expanded length of spring S, that results from the use of spring keepers 14', 16' instead of spring keepers 14, 16 (compare FIGS. 2a and 3), depending on the nature of the spring S and the actual preloads and extended lengths involved, it may be necessary to use a spring S that is longer and/or of a different spring rate when using the spring keepers 14', 16' instead of the spring keepers 14, 16.

In the embodiments described so far, the return spring S and its upper and lower spring keepers 14, 16, together with lands 9c and 9d, have served to produce a cushioned stopping of lower plunger 9. However, a cushioned stopping of the lower plunger can be obtained in other manners, examples of which will now be described with respect to the embodiments of FIGS. 5 and 6. In these figures, parts which are unchanged relative to those of the preceding embodiments bear like reference numerals, and double prime (") and triple prime (''') designations are used to indicate parts which have been modified, and only those differences which exist relative to the foregoing embodiments will be specifically discussed. These embodiments have the advantage that they are not exclusively dependent on the spring rate of the return spring S for producing a damped stopping of the return stroke of the lower plunger. Thus, changes made to increase the capacity of an injector, do not affect these stop arrangements, thereby further reducing the number of parts which must be exchanged when the stroke length of the lower plunger is to be changed.

Figure 5:
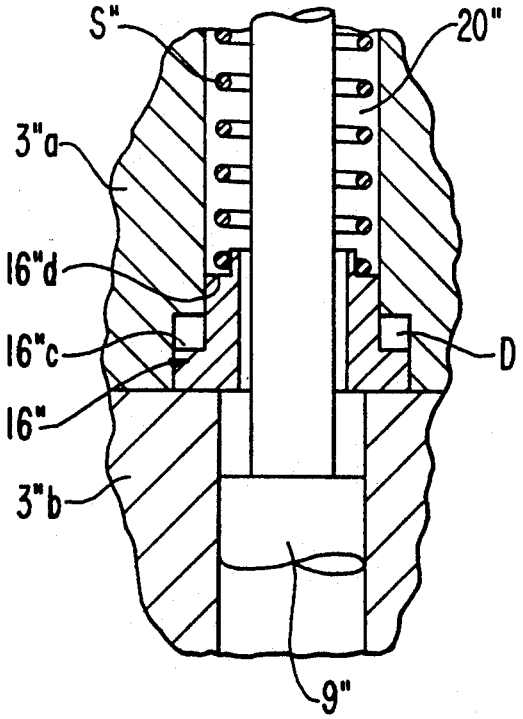
FIG. 5 is a view of a hydraulically damped lower plunger stop.

In FIG. 5, it can be seen that the spring recess 20" has a smaller diameter and the lower end of the spring S" (which is also of reduced diameter) is seated on an upper flanged portion 16"d of the lower spring keeper 16" instead of on the flange 16c". Additionally, the flange 16c" of the lower spring keeper is shown received in a damping chamber D. With this arrangement, during the return stroke of the plunger 9", it still abuts against the lower spring keeper 16"; however, instead of the force of spring S" providing the sole cushioning effect and plunger travel being limited by engagement of a land on the lower plunger with the upper spring keeper, the cushioning effect of spring S" is supplemented by the damping effect of air trapped in chamber D being compressed by flange 16"c and the lash or play limited by the height of the chamber D.

Figure 6:
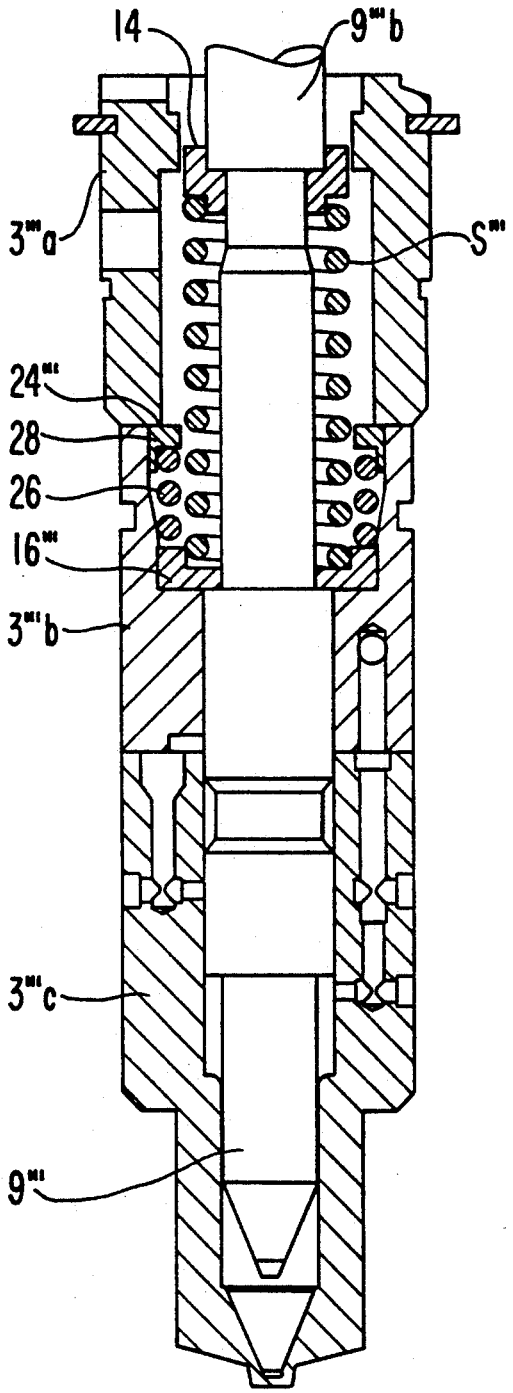
FIG. 6 is a cross-sectional view of another embodiment of a fuel injector having a spring-cushioned lower plunger stop.

In the embodiment of FIG. 6, the supplemental cushioning effect is produced by providing a damping spring 26 which acts between the lower spring keeper 16''' for the return spring S''' and a second upper keeper 28. This second upper keeper for the damping spring 26 engages a stop surface 24" on the upper barrel part 3'''a. It is noted that the stop surface 24''' is shifted downwardly relative to the position of stop surface 24 in the prior embodiments since the upper keeper no long requires a stop other than that provided by the 9'''b land of the lower plunger 9'''.

From the foregoing, it should now be apparent how the present invention provides an improved high pressure fuel injector for internal combustion engines in which the problem of large quantities of air being drawn into the injector from the combustion chamber during the retraction stroke can be avoided by limiting the return stroke of the lower plunger to a distance that is significantly less than that of the stroke of the upper plunger of the plunger assembly. Furthermore, it can be seen how the present invention affords a cushioned stopping of the return movement of the lower plunger and is also able to allow fuel injectors, having different maximum injectable charge capabilities, to be produced from the same basic set of components without requiring more than the return spring assembly and injector nozzle to be changed.

INDUSTRIAL APPLICABILITY

The present invention will find applicability in a wide range of fuel injection systems for internal combustion engines, particularly diesel engines. The invention will be especially useful where it is desired to have a single fuel injection system that is able to be easily and inexpensively adapted to meet the fuel dosage requirements of a range of different engines and engine use conditions.

We claim:

1. In a fuel injector of the open nozzle type having an injector body containing a central bore with an injection nozzle having a valveless open nozzle orifice at a lower end thereof, a plunger assembly having an upper plunger and a lower plunger mounted for reciprocal motion within the central bore with an injection travel toward said injection nozzle for producing injection of fuel from the nozzle orifice and a return travel away from said injection nozzle, and a variable volume injection chamber in said lower end of the central bore and defined between the open nozzle orifice of said injection nozzle and a bottom end of the lower plunger, the improvement comprising cushioning means for limiting return travel of the lower plunger to less than that of said upper plunger in an impact absorbing manner.

2. A fuel injector according to claim 1, wherein spring means is provided for returning the lower plunger to a raised position during retraction of said upper plunger, said spring means being retained between an upper spring keeper and a lower spring keeper; wherein first abutment means is provided on said lower plunger for engaging upon said lower spring keeper and transferring upward momentum of said lower plunger to said lower spring keeper; and wherein damping means is provided for absorbing the momentum transferred to said lower spring keeper.

3. A fuel injector according to claim 2, wherein said damping means comprises a flange on said lower spring keeper which is received in a damping chamber.

4. A fuel injector according to claim 3, wherein said injector body comprises an upper injector barrel part, a lower injector barrel part, an injector cup having an injection nozzle with spray orifices for spraying fuel into the combustion chamber of an internal combustion engine, and a retainer which receives the injector cup with the injection nozzle projecting from a bottom end thereof, and wherein the retainer secures the injector cup and lower barrel part together in end-to-end fashion with the upper barrel part.

5. A fuel injector according to claim 2, wherein said damping means comprises a damping spring acting between the lower spring keeper and a damping spring upper keeper, and wherein a stop surface is provided in the injector body for preventing upward movement of said damping spring upper keeper.

6. A fuel injector according to claim 5, wherein said injector body comprises an upper injector barrel part, a lower injector barrel part, an injector cup having an injection nozzle with spray orifices for spraying fuel into the combustion chamber of an internal combustion engine, and a retainer which receives the injector cup with the injection nozzle projecting from a bottom end thereof, and wherein the retainer secures the injector cup and lower barrel part together in end-to-end fashion with the upper barrel part.

7. A fuel injector according to claim 1, wherein a timing plunger is disposed in said central bore between the upper plunger and the lower plunger, and wherein a variable volume timing chamber is located between the upper plunger and the timing plunger.

8. A fuel injector according to claim 7, wherein spring means is provided for retaining the lower plunger to a raised position during retraction of said upper plunger, said spring means being retained between an upper spring keeper and a lower spring keeper; wherein first abutment means is provided on said lower plunger for engaging upon said lower spring keeper and transferring upward momentum of said lower plunger to said spring means.

9. A fuel injector according to claim 7, wherein spring means is provided for returning the lower plunger to a raised position during retraction of said upper plunger, said spring means being retained between an upper spring keeper and a lower spring keeper; wherein first abutment means is provided on said lower plunger for engaging upon said lower spring keeper and transferring upward momentum of said lower plunger to said lower spring keeper; and wherein damping means is provided for absorbing the momentum transferred to said lower spring keeper.

10. In a fuel injector of the open nozzle type having an injector body containing a central bore with an injection nozzle at a lower end thereof, a plunger assembly having an upper plunger and a lower plunger mounted for reciprocal motion within the central bore and a variable volume injection chamber in said lower end of the central bore between the injection nozzle and a bottom end of the lower plunger, the improvement comprising cushioning means for limiting return travel of the lower plunger to less than that of said upper plunger in an impact absorbing manner; wherein spring means is provided for returning the lower plunger to a raised position during retraction of said upper plunger, said spring means being retained between an upper spring keeper and a lower spring keeper; wherein first abutment means is provided on said lower plunger for engaging upon said lower spring keeper and transferring upward momentum of said lower plunger to said spring means.

11. A fuel injector according to claim 10, wherein second abutment means is provided on said lower plunger for engaging upon said upper spring keeper to prevent further return movement of said lower plunger during continuing retraction of said upper plunger after engagement of the first abutment means on said lower spring keeper.

12. A fuel injector according to claim 11, wherein said first abutment means is a land which is engageable in a counterbore formed in a lower end of the lower spring keeper and wherein said second abutment means is a second land formed on the lower plunger which is engageable on a lower end of the upper spring keeper.

13. A fuel injector according to claim 12, wherein said upper spring keeper has a peripheral flange, an upper side of which abuts on a stop surface formed in the body of the fuel injector and a lower side of which is engaged by an upper end of the spring means; and wherein a plurality of upper spring keepers are exchangably mountable in the injector, the flange of each said upper spring keeper having a different thickness between its upper and lower sides for enabling the maximum stroke length of the lower plunger to be variably selectable by selecting a particular upper spring keeper.

14. A fuel injector according to claim 13, wherein a plurality of lower spring keepers are exchangably mountable in the injector, each said lower spring keeper having a counterbore of a different depth for enabling the maximum stroke length of the lower plunger to be variably selectable by selecting a particular lower spring keeper.

15. A fuel injector according to claim 12, wherein said injector body comprises an upper injector barrel part, a lower injector barrel part, an injector cup having an injection nozzle with spray orifices for spraying fuel into the combustion chamber of an internal combustion engine, and a retainer which receives the injector cup with the injection nozzle projecting from a bottom end thereof, and wherein the retainer secures the injector cup and lower barrel part together in end-to-end fashion with the upper barrel part.

16. A fuel injector according to claim 12, wherein a plurality of lower spring keepers are exchangably mountable in the injector, each said lower spring keeper having a counterbore of a different depth for enabling the maximum stroke length of the lower plunger to be variably selectable by selecting a particular lower spring keeper.

17. A fuel injector according to claim 13, wherein a notch is provided in said flange of each upper spring keeper for providing a drain path past the upper spring keeper.

18. A fuel injector according to claim 17, wherein said injector body comprises an upper injector barrel part, a lower injector barrel part, an injector cup having an injection nozzle with spray orifices for spraying fuel into the combustion chamber of an internal combustion engine, and a retainer which receives the injector cup with the injection nozzle projecting from a bottom end thereof, and wherein the retainer secures the injector cup and lower barrel part together in end-to-end fashion with the upper barrel part.

19. A fuel injector according to claim 13, wherein each upper spring keeper is horseshoe shaped for enabling the upper spring keeper to be slid radially onto a reduced diameter portion of the lower plunger.

20. A fuel injector according to claim 19 wherein said injector body comprises an upper injector barrel part, a lower injector barrel part, an injector cup having an injection nozzle with spray orifices for spraying fuel into the combustion chamber of an internal combustion engine, and a retainer which receives the injector cup with the injection nozzle projecting from a bottom end thereof, and wherein the retainer secures the injector cup and lower barrel part together in end-to-end fashion with the upper barrel part.

21. A fuel injector according to claim 19, wherein a retainer spring and spring clip are provided for securing the selected upper spring keeper on the lower plunger.

* * * * *